US010453601B2

(12) United States Patent
Kobayashi et al.

(10) Patent No.: US 10,453,601 B2
(45) Date of Patent: Oct. 22, 2019

(54) COIL DEVICE

(71) Applicant: TDK CORPORATION, Tokyo (JP)

(72) Inventors: Katsumi Kobayashi, Tokyo (JP); Yoshiyuki Takanashi, Tokyo (JP)

(73) Assignee: TDK CORPORATION, Tokyo (JP)

( * ) Notice: Subject to any disclaimer, the term of this patent is extended or adjusted under 35 U.S.C. 154(b) by 148 days.

(21) Appl. No.: 15/471,594

(22) Filed: Mar. 28, 2017

(65) Prior Publication Data

US 2017/0309392 A1 Oct. 26, 2017

(30) Foreign Application Priority Data

Apr. 20, 2016 (JP) ..... 2016-084702

(51) Int. Cl.

| | |
|---|---|
| ***H01F 27/29*** | (2006.01) |
| ***H01F 27/28*** | (2006.01) |
| ***H01F 27/26*** | (2006.01) |
| *H01F 3/14* | (2006.01) |

(52) U.S. Cl.

CPC ..... *H01F 27/292* (2013.01); *H01F 27/263* (2013.01); *H01F 27/2823* (2013.01); *H01F 27/2828* (2013.01); *H01F 3/14* (2013.01)

(58) Field of Classification Search

USPC ..... 336/200, 232, 192, 83

See application file for complete search history.

(56) References Cited

U.S. PATENT DOCUMENTS

2013/0027161 A1* 1/2013 Urano ..... H01F 17/04 336/83
2015/0116070 A1* 4/2015 Arai ..... H01F 17/045 336/192
2016/0217919 A1* 7/2016 Iwata ..... H01F 27/29

FOREIGN PATENT DOCUMENTS

JP 2015-037156 * 2/2015
JP 2015-037156 A 2/2015

* cited by examiner

*Primary Examiner* — Elvin G Enad
*Assistant Examiner* — Kazi S Hossain
(74) *Attorney, Agent, or Firm* — Oliff PLC

(57) ABSTRACT

A coil device includes an inner core having a winding core and a pair of flanges, a wire, an outer core arranged outside the inner core, a first terminal with a first wirebound having a first wirebound bottom arranged axially on a core end surface of the outer core and connected to a first end of the wire, and a second terminal with a second wirebound having a second wirebound bottom arranged on the core end surface and connected to a second end of the wire. The first wirebound has a first wire fixing portion bending from the first wirebound bottom toward a first rotating direction and fixing the first end. The second wirebound has a second wire fixing portion bending from the second wirebound bottom toward the same rotating direction as the first rotating direction and fixing the second end.

7 Claims, 10 Drawing Sheets

COIL DEVICE

BACKGROUND OF THE INVENTION

1. Field of the Invention

The present invention relates to a coil device, and in particular to a coil device provided with an inner core wound by a wire and an outer core arranged on an outer periphery of the inner core.

2. Description of the Related Art

The prior art proposes a coil device provided with an inner core constituted by a drum core wound by a wire and an outer core having a through hole housing the inner core. A terminal electrode electrically connected to an end of the wire is fixed to the outer core, and electric power is supplied to the wire of the drum core via the terminal electrode.

There has been proposed a shape of the terminal electrode attached to the outer core having a fixing portion fixed to the outer core, a wirebound portion connected to the end of the wire, and a connection portion connecting the fixing portion and the wirebound portion. Furthermore, there has been proposed a preferable shape of the wirebound portion easily and securely fixing the wire to the terminal electrode by having a pressing portion that presses the end of the wire.

Patent Document 1: JP 2015-37156A

SUMMARY OF THE INVENTION

However, the shape of the wirebound portion in the prior art has a problem that a positional displacement of a center of the inner core to the outer core is generated at the time of pressing the end of the wire by the pressing portion of the wirebound portion. Such a problem of positional displacement is required to be improved for the achievement of downsizing of the coil device and the prevention of characteristic variations of the coil device.

The present invention has been achieved under such circumstances. It is an object of the invention to provide a coil device capable of preventing a positional displacement of an inner core with respect to an outer core.

The coil device according to the present invention is a coil device including:

an inner core having a winding core with column shape extending in an axial direction and a pair of flanges arranged on both sides of the winding core;

a wire having a winding portion winding around the winding core;

an outer core having a through hole inserted by the inner core and being arranged on an outer periphery of the inner core;

a first terminal portion provided with a first wirebound portion having a first wirebound bottom portion arranged on a core end surface of one of end surfaces of the outer core in the axial direction and connected to a first end of one of ends of the wire; and a second terminal portion provided with a second wirebound portion having a second wirebound bottom portion arranged at a position rotated in a peripheral direction by a predetermined angle from the first wirebound bottom portion on the core end surface and connected to a second end of the other end of the wire, wherein the first wirebound portion is provided with a first wire fixing portion bending from the first wirebound bottom portion toward a first rotating direction as seen from a tip side of the first end and fixing the first end, and the second wirebound portion is provided with a second wire fixing portion bending from the second wirebound bottom portion toward the same rotating direction as the first rotating direction as seen from a tip side of the second end and fixing the second end.

In the coil device according to the prevent invention, the first wire fixing portion of the first terminal portion bends toward the first rotating direction and fixes the first end of the wire, and the second wire fixing portion of the second terminal portion bends toward the same rotating direction as the first rotating direction and fixes the second end of the wire. In the coil device having the first terminal portion and the second terminal portion, even if the first and second wire fixing portions bend and fix both ends of the wire, a force toward a direction where a center of the inner corner is displaced is hard to be generated even though a force toward a direction where the inner core is rotated is generated, and it is possible to prevent a problem of positional displacement of a center of the inner core to the outer core.

For example, the first wirebound portion may be provided with a first support portion protruding from the first wirebound bottom portion toward a reverse rotating direction of the first rotating direction as seen from the tip side of the first end and touching the first end on its winding side compared to the first wire fixing portion, and the second wirebound portion may be provided with a second support portion protruding from the second wirebound bottom portion toward a reverse rotating direction of the first rotating direction as seen from the tip side of the second end and touching the second end on its winding side compared to the second wire fixing portion.

With the support portion protruding from the wirebound bottom portion toward the reverse rotating side, it is possible to prevent a problem that a force of moving or rotating the inner core is generated when the fixing portion fix the end of the wire. When the support portion touches the end of the wire on the winding side from the wire fixing portion, it is possible to prevent a problem that the support portion becomes unobstructive at the time of permanently fixing the first wire fixing portion and the first end. With the support portion, a heat at the time of permanently fixing the first wire fixing portion and the first end can be prevented from being transmitted to the winding portion.

Incidentally, the winding side of the first end means a side of the first end near the winding portion, and the winding side of the second end means a side of the second end near the winding portion.

For example, the first wire fixing portion may be provided with a first welding portion welded to the first end and a first caulking portion connected to the first wirebound bottom portion with a predetermined space to the first welding portion and temporarily fixing the first end on its winding side compared to the first welding portion, and the second wire fixing portion may be provided with a second welding portion welded to the second end and a second caulking portion connected to the second wirebound bottom portion with a predetermined space to the second welding portion and temporarily fixing the second end on its winding side compared to the second welding portion.

When the wire fixing portion is provided with the welding portion for permanently fixing the end of the wire and the caulking portion for temporarily fixing the end of the wire, it is possible to easily and quickly fix the end of the wire and improve accuracy of fixed positions of the wire, the inner core, and the like.

For example, a connection position between the first wirebound bottom portion and the first welding portion may be distant from the first end more than a connection position between the first wirebound bottom portion and the first caulking portion, and a connection position between the second wirebound bottom portion and the second welding portion may be distant from the second end more than a connection position between the second wirebound bottom portion and the second caulking portion.

When the connection position between the welding portion and the wirebound bottom portion is distant more than the connection position between the caulking portion and the wirebound bottom position, the end of the wire temporarily fixed by the caulking portion receives a force at the time of bending the welding portion, and it is possible to prevent a problem of positional displacement of the end of the wire and the inner core.

DESCRIPTION OF THE PREFERRED EMBODIMENTS

Figure 1:
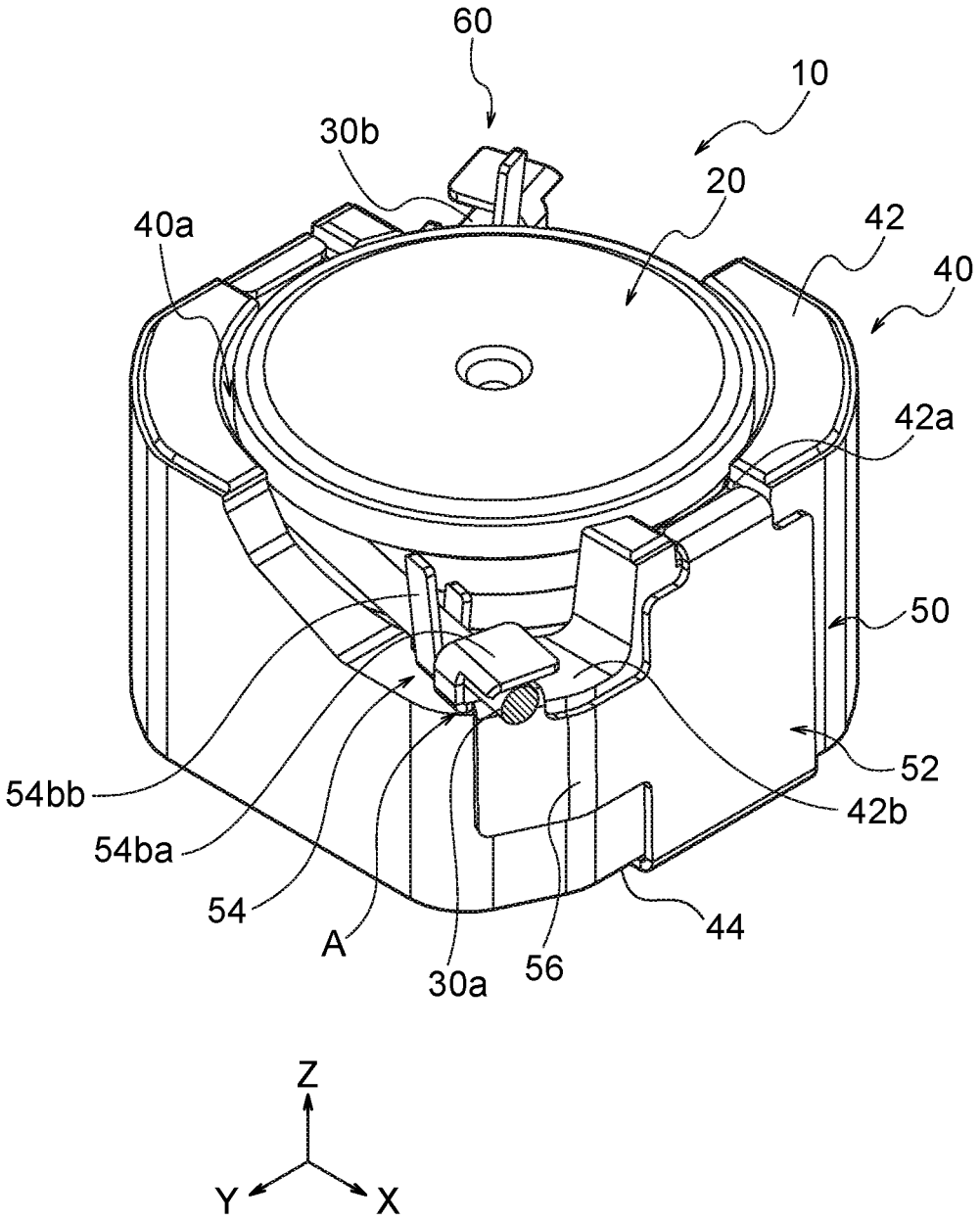
FIG. 1 is a whole perspective view of a coil device according to First Embodiment of the present invention.

FIG. 1 is a whole perspective view of a coil device 10 according to First Embodiment of the present invention. The coil device 10 has an inner core 20 with a drum shape, a wire 30 winding around the inner core 20, an outer core 40 arranged on an outer periphery of the inner core 20, and a first terminal portion 50 and a second terminal portion 60 of a pair of terminal portions attached to the outer core 40. For example, the coil device 10 is mounted on a substrate or so in a state where a winding core 22 of the inner core 20 has an axial direction corresponding to a vertical direction to a mounting surface. In the following explanation, as shown in FIG. 1, the Z-axis direction is an axial direction of the winding core 22 of the inner core 20, and the X-axis direction and the Y-axis direction are directions perpendicular to the Z-axis. In the present specification, an upward direction means a positive direction of the Z-axis, and a downward direction means a negative direction of the Z-axis unless otherwise specified.

Figure 2:
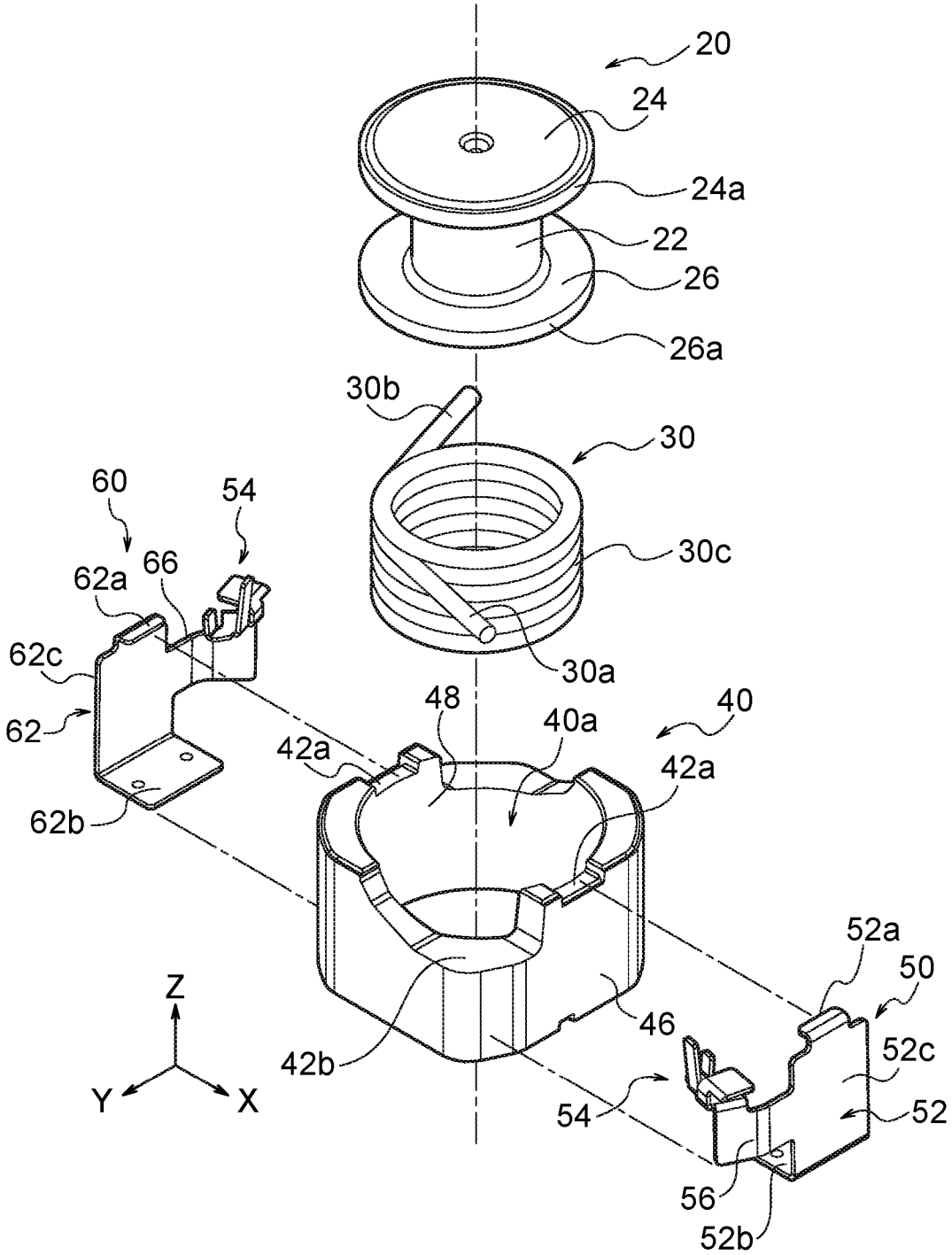
FIG. 2 is an exploded perspective view of the coil device shown in FIG. 1.

FIG. 2 is an exploded perspective view of the coil device 10 shown in FIG. 1. The inner core 20 has the winding core 22 with column shape extending in the axial direction and an upper flange 24 and a lower flange 26 of a pair of flanges arrange on both ends of the winding core 22. The inner core 20 is wound by the wire 30. A winding portion 30*c* winding around the winding core 22 is arranged on the surface of the winding core 22, and a first end 30*a* and a second end 30*b* of ends of the wire 30 are pulled out in the vicinity of the upper flange 24 from the surface of the winding core 22 toward the outer diameter side.

Figure 7:
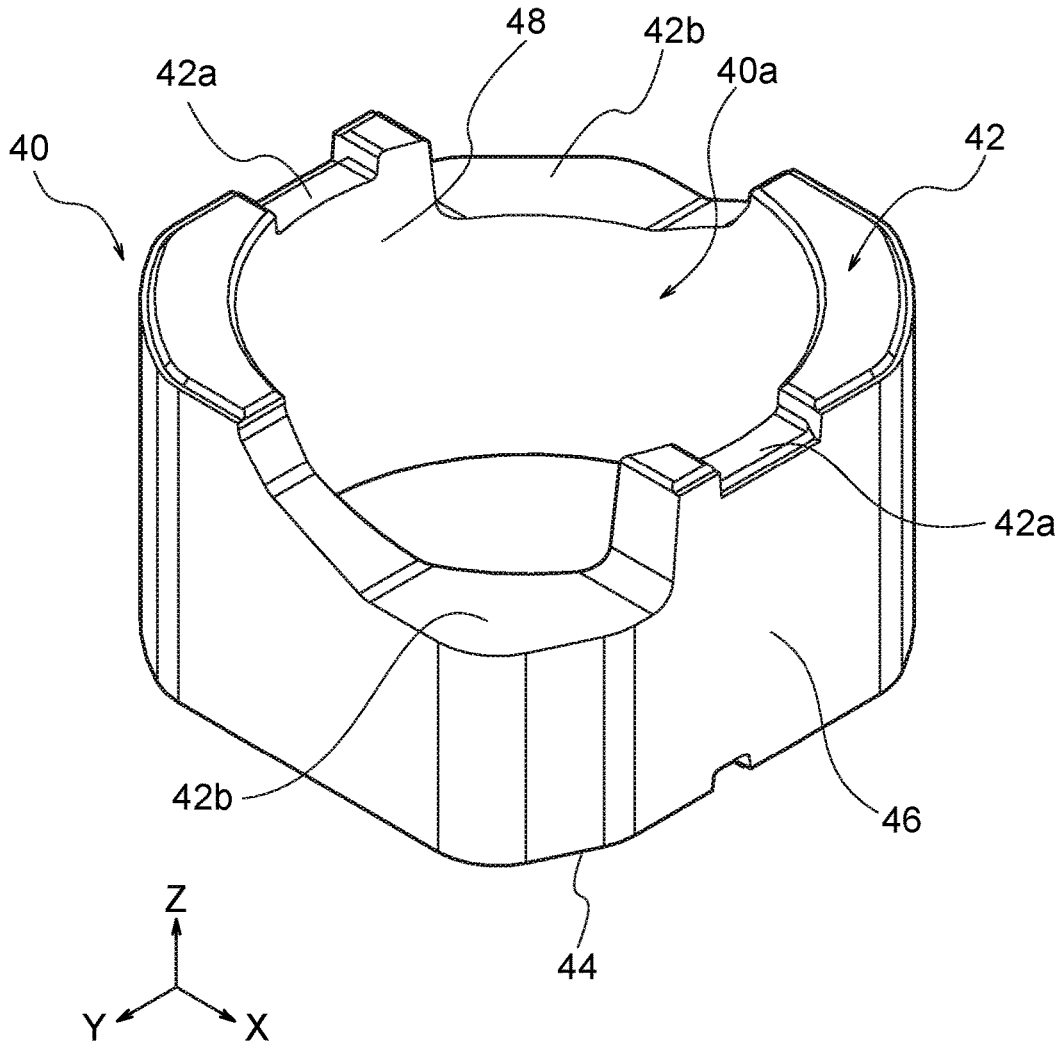
FIG. 7 is a perspective view of an outer core of the coil device shown in FIG. 1.

The outer core 40 is provided with a through hole 40*a* inserted by the inner core 20. As shown in FIG. 1, the inner core 20 wound by the wire 30 is housed in the through hole 40*a* of the outer core 40 in a state where the coil device 10 is assembled. As shown in FIG. 2 and FIG. 7, a wall surface of the through hole 40*a* is constituted by a core inner peripheral surface 48 of an inner peripheral surface of the outer core 40.

Thus, as shown in FIG. 2, the core inner peripheral surface 48 of the outer core 40 opposes to an upper flange outer peripheral surface 24*a* of an outer peripheral surface of the upper flange 24 of the inner core 20 and a lower flange outer peripheral surface 26*a* of an outer peripheral surface of the lower flange 26 of the inner core 20. A predetermined space (gap) is formed between the core inner peripheral surface 48 of the outer core 40 and the upper and lower flange outer peripheral surfaces 24*a* and 26*a* of the inner core 20. The core inner peripheral surface 48 and the upper and lower flange outer peripheral surfaces 24*a* and 26*a* are joined by an adhesive hardened portion (not shown) formed in such a manner that an adhesive of an epoxy based resin, a urethane based resin, or the like is hardened, and the outer core 40 and the inner core 20 are fixed mutually. Thus, the adhesive hardened portion is arranged in the core inner peripheral surface 48 and the upper and lower flange outer peripheral surfaces 24*a* and 26*a*. The outer core 40 is connected to the inner core 20 and forms a magnetic path, and the adhesive hardened portion present between the outer core 40 and the inner core 20 function as a gap material.

Figure 3:
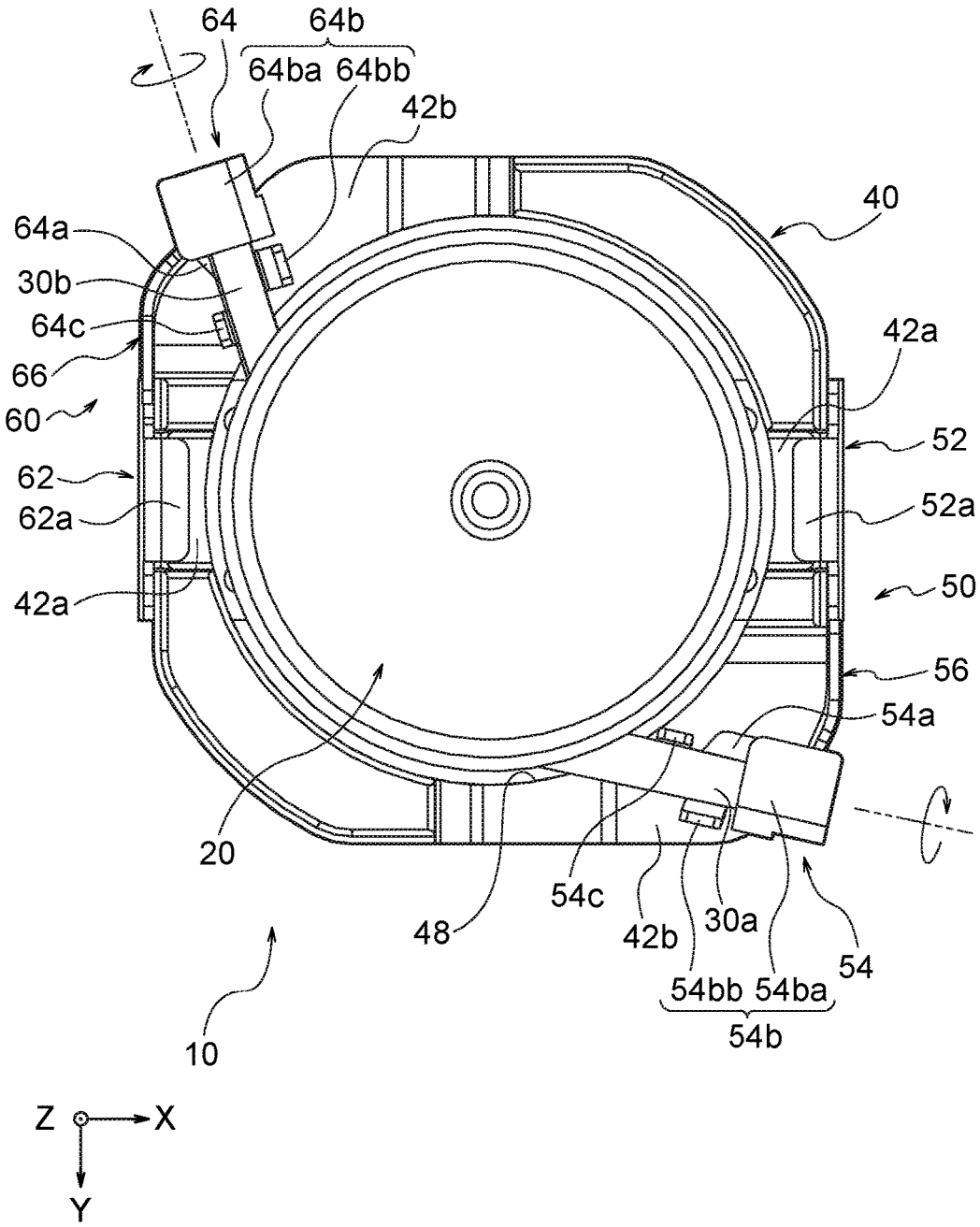
FIG. 3 is a plane view of the coil device shown in FIG. 1.

As shown in FIG. 3 of a plane view seeing the outer core 4 from the axial direction (Z-axis direction), the outer core 40 has an approximately rectangular outer peripheral shape having four corners of R shape when viewing the outer core 40 from the axial direction. In contrast, the core inner peripheral surface 48 of the outer core 40 has a circular peripheral shape when viewing the outer core 40 from the axial direction, and has a peripheral shape different from that of a core outer peripheral surface 46 of the outer core 40. Thus, a radial thickness of the outer core 40 determined by a radial distance between the core inner peripheral surface 48 and the core outer peripheral surface 46 varies along the peripheral direction of the outer core 40.

A core upper surface 42 is a core end surface that is one (Z-axis positive direction) of end surfaces of the outer core 40, and is provided with a pair of engagement end surfaces 42*a* and a pair of support end surfaces 42*b*. A first upper surface portion 52*a* of the first terminal portion 50 and a second upper surface portion 62*a* of the second terminal portion 60 mentioned below are engaged on the engagement end surfaces 42*a*. The engagement end surfaces 42*a* are formed on both ends in the X-axis direction in the middle part of the core upper surface 42 in the Y-axis direction.

As shown in FIG. 3, the support end surfaces 42*b* are formed on two corners positioned on a diagonal line on the core upper surface 42. The support end surfaces 42*b* are respectively provided with a first wirebound bottom portion 54*a* of the first terminal portion 50 and a second wirebound bottom portion 64*a* of the second terminal portion 60. As shown in FIG. 7, the support end surfaces 42*b* have a short distance to a core lower surface 44 of an end surface of the outer core 40 in the downward direction compared to the engagement end surfaces 42*a* and are arranged lower than the engagement end surfaces 42*a*. As shown in FIG. 3, the support end surfaces 42*b* have a maximum thickness in the radial direction that is larger than that of the engagement end surfaces 42*a*.

As shown in FIG. 2, the first terminal portion 50 is provided with a first fixing portion 52 fixed to the outer core 40, a first wirebound portion 54 connected to the first end 30*a* of one of ends of the wire 30, and a first connection portion 56 connecting the first wirebound portion 54 and the first fixing portion 52. The first terminal portion 50 is attached to the X-axis positive direction side of the outer core 40.

Figure 5:
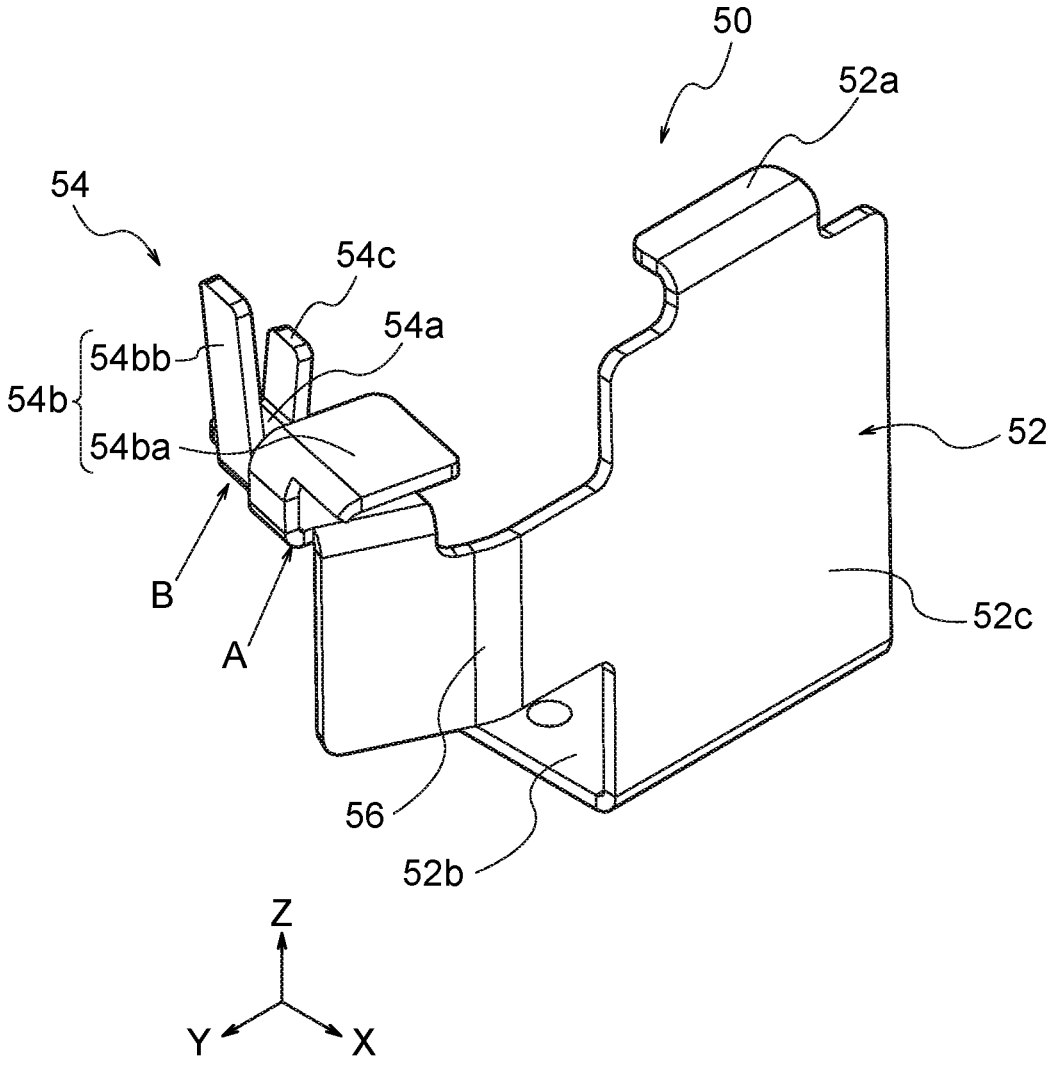
FIG. 5 is a perspective view of the first terminal portion of the coil device shown in FIG. 1.

As shown in FIG. 2 and FIG. 5, the first fixing portion 52 is provided with a first upper surface portion 52*a*, a first lower surface portion 52*b*, and a first side surface portion 52*c*. The first upper surface portion 52*a* is engaged with the engagement end surface 42*a* on the X-axis positive direction side of the outer case 40. The first lower surface portion 52*b* is engaged with the core lower surface 44 of the outer core 40. The first side surface portion 52*c* connects the first upper surface portion 52*a* and the first lower surface portion 52*b* and opposes to the core outer peripheral surface 46 of the outer core 40. The first upper surface portion 52*a* and the first lower surface portion 52*b* form an angle of approximately 90 degrees to the first side surface portion 52*c* (approximately L shape with the first side surface portion 52*c*) and are connected to the upper and lower ends of the first side surface portion 52*c*. The first lower surface portion 52*b* is provided with a convex portion engaged with a concave portion formed on the core lower surface 44 of the outer core 40.

As shown in FIG. 5, a radial length of the first upper surface portion 52*a* and a radial length of the first lower surface portion 52*b* are different from each other. As shown in FIG. 3 of a plane view, a radial tip of the first upper surface portion 52*a* is positioned on an outer diameter side of the core inner peripheral surface 48 of the outer core 40, but as shown in FIG. 2, a radial tip of the first lower surface portion 52*b* is positioned on an inner diameter side of the lower flange outer peripheral surface 26*a*. The first fixing portion 52 of the first terminal portion 50 is fixed to the outer core 40 via the adhesive hardened portion connecting an inner surface of the first side surface portion 52*c* and the core outer peripheral surface 46 of the outer core 40.

Figure 4:
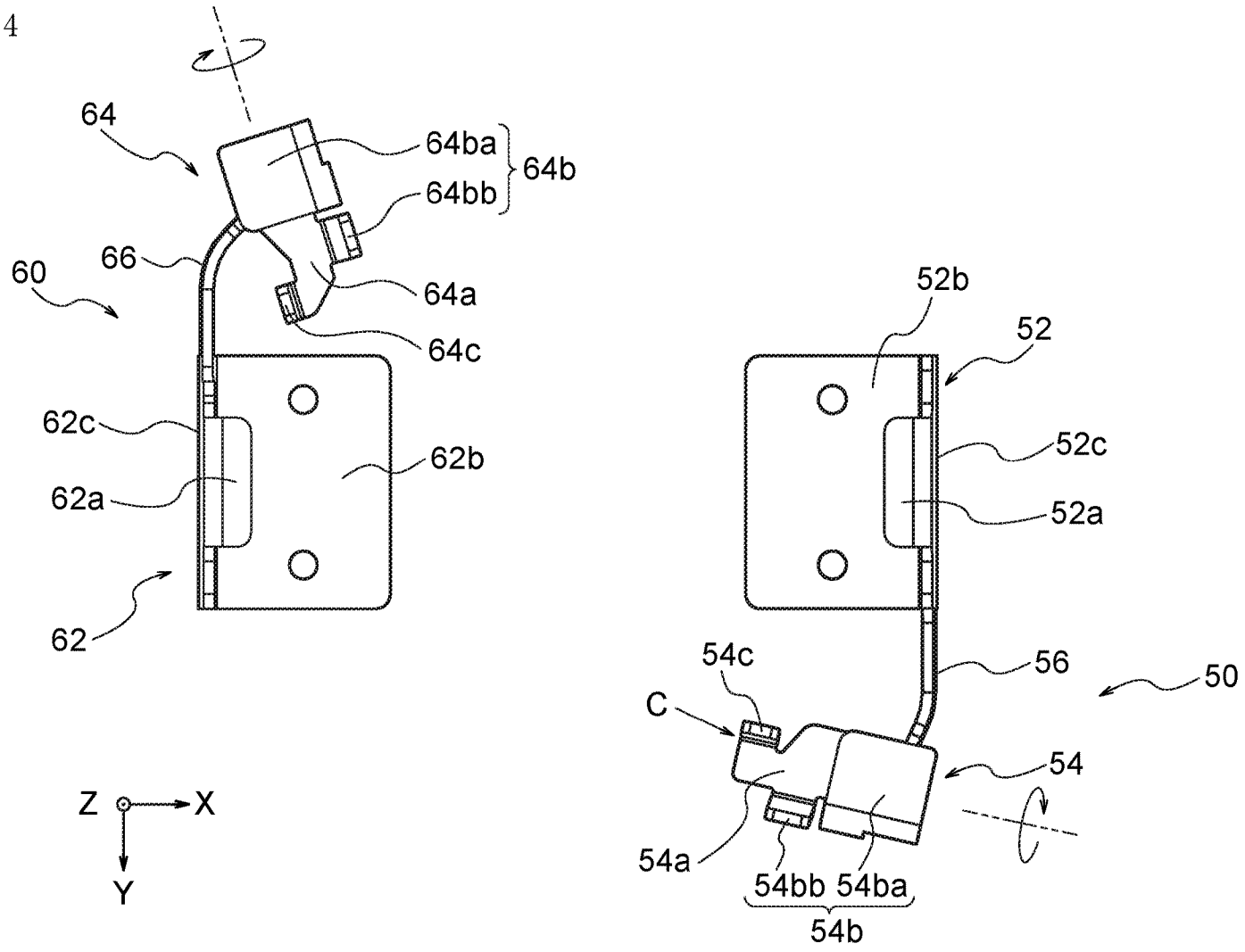
FIG. 4 is a plane view showing an arrangement of a first terminal portion and a second terminal portion of the coil device show in FIG. 1.

As shown in FIG. 4 and FIG. 5, the first wirebound portion 54 of the first terminal portion 50 is provided with the first wirebound bottom portion 54*a*, a first wire fixing portion 54*b*, and a first support portion 54*c*. The first wirebound bottom portion 54*a* is parallel to the XY plane perpendicular to the axial direction. The first wire fixing portion 54*b* and the first support portion 54*c* are curved toward a predetermined direction to the first wirebound bottom portion 54*a* and are connected thereto. As shown in FIG. 3, the first wirebound bottom portion 54*a* is arranged on the support end surface 42*b* of the core upper surface 42 of the outer core 40.

As shown in FIG. 3, the first wire fixing portion 54*b* is provided with a first welding portion 54*ba* welded to the first end 30*a* of the wire 30 and a first caulking portion 54*bb* connected to the first wirebound bottom portion 54*a* with a predetermined distance to the first welding portion 54*ba*. As mentioned below, the first caulking portion 54*bb* temporarily fixes the first end 30*a* on the winding side of the first end 30*a* (near the winding portion 30*c* (see FIG. 2)) compared to the first welding portion 54*ba*.

As shown in FIG. 3 and FIG. 4, the first welding portion 54*ba* and first caulking portion 54*bb* constituting the first wire fixing portion 54*b* bend from the first wirebound bottom portion 54*a* toward a clockwise direction of a first rotating direction as seen from a tip side of the first end 30*a* (approximately corresponding to the X-axis positive direction) and fix the first end 30*a*. Incidentally, FIG. 1 to FIG. 6, etc. show a state where the first caulking portion 54*bb* does not fix the first end 30*a*, but this is for convenience so that the shape of the first caulking portion 54*bb* (and a second caulking portion 64*bb*) is illustrated intelligibly. In the coil device 10 after actually being completed, the first caulking portion 54*bb* (and the second caulking portion 64*bb*) bends further in the clockwise direction from the state shown in FIG. 1 to FIG. 6 and fixes the first end 30*a* by caulking. Since the first caulking portion 54*bb* temporarily fixes the first end 30*a* by caulking, it is advantageous that the first end 30*a* being temporarily fixed (before the first welding portion 54*ba* is welded) is hard to be displaced positionally compared to a conventional terminal having the first end 30*a* sandwiched between V-shape protruding pieces.

As shown in FIG. 1, a connection position "A" between the first wirebound bottom portion 54*a* and the first welding portion 54*ba* is distant from the first end 30*a*. As shown in FIG. 5, the connection position "A" between the first wirebound bottom portion 54*a* and the first welding portion 54*ba* is consequently distant from the first end 30*a* more than a connection position "B" between the first wirebound bottom portion 54*a* and the first caulking portion 54*bb*.

As shown in FIG. 3, the first support portion 54*c* touches the first end 30*a* on its winding side compared to the first wire fixing portion 54*b*. As shown in FIG. 3 and FIG. 5, the first support portion 54*c* protrudes from the first wirebound bottom portion 54*a* toward a counterclockwise side of a reverse rotating direction side of the first rotating direction side as seen from the tip side of the first end 30*a*. Thus, the first end 30*a* of the wire 30 is pulled out toward the outer diameter direction on the first wirebound bottom portion 54*a* via between the first support portion 54*c* and the first caulking portion 54*bb*. Incidentally, the first support portion 54*c* does not fix the first end 30*a* in the same manner as the first caulking portion 54*bb* in FIG. 3 to FIG. 5, etc. In the coil device 10 after being completed, however, the first support portion 54*c* may bend further in the counterclockwise direction from the state shown in FIG. 3 to FIG. 5 and fix the first end 30*a* by caulking. The connection position "A" between the first wirebound bottom portion 54*a* and the first welding portion 54*ba* is preferably distant from the first end 30*a* more than a connection position "C" (see FIG. 4) between the first wirebound bottom portion 54*a* and the first support portion 54*c*.

As shown in FIG. 1 to FIG. 4, the first connection portion 56 is arranged along the core outer peripheral surface 46 and connects the first side surface portion 52*c* of the first fixing portion 52 and the first wirebound bottom portion 54*a* of the first wirebound portion 54. Incidentally, although not limited, the first side surface portion 52*c* of the first fixing portion 52 of the first terminal portion 50 is preferably only one that is directly adhered to the outer core 40. When only the first side surface portion 52*c* of the first terminal portion 50 is adhered to the outer core 40, the first wirebound bottom portion 54*a* of the first wirebound portion 54 and the first connection portion 56 oppose to the support end surface 42*b* or the core outer peripheral surface 46 of the outer core 40, but are not directly fixed to the surface of the outer core 40.

As shown in FIG. 2, the second terminal portion 60 is provided with a second fixing portion 62 fixed to the outer core 40, a second wirebound portion 64 connected to the second end 30*b* of the other end of the wire 30, and a second connection portion 66 connecting the second wirebound portion 64 and the second fixing portion 62. As shown in FIG. 3, the second wirebound bottom portion 64*a* of the second terminal portion 60 is arranged on the support end surface 42*b* at a position rotated in the peripheral direction by a predetermined angle (approximately 180 degrees in the embodiment) from the first wirebound bottom portion 54*a* of the first terminal portion 50. The first terminal portion 50 is attached to the negative side in the X-axis direction of the outer core 40.

Figure 6:
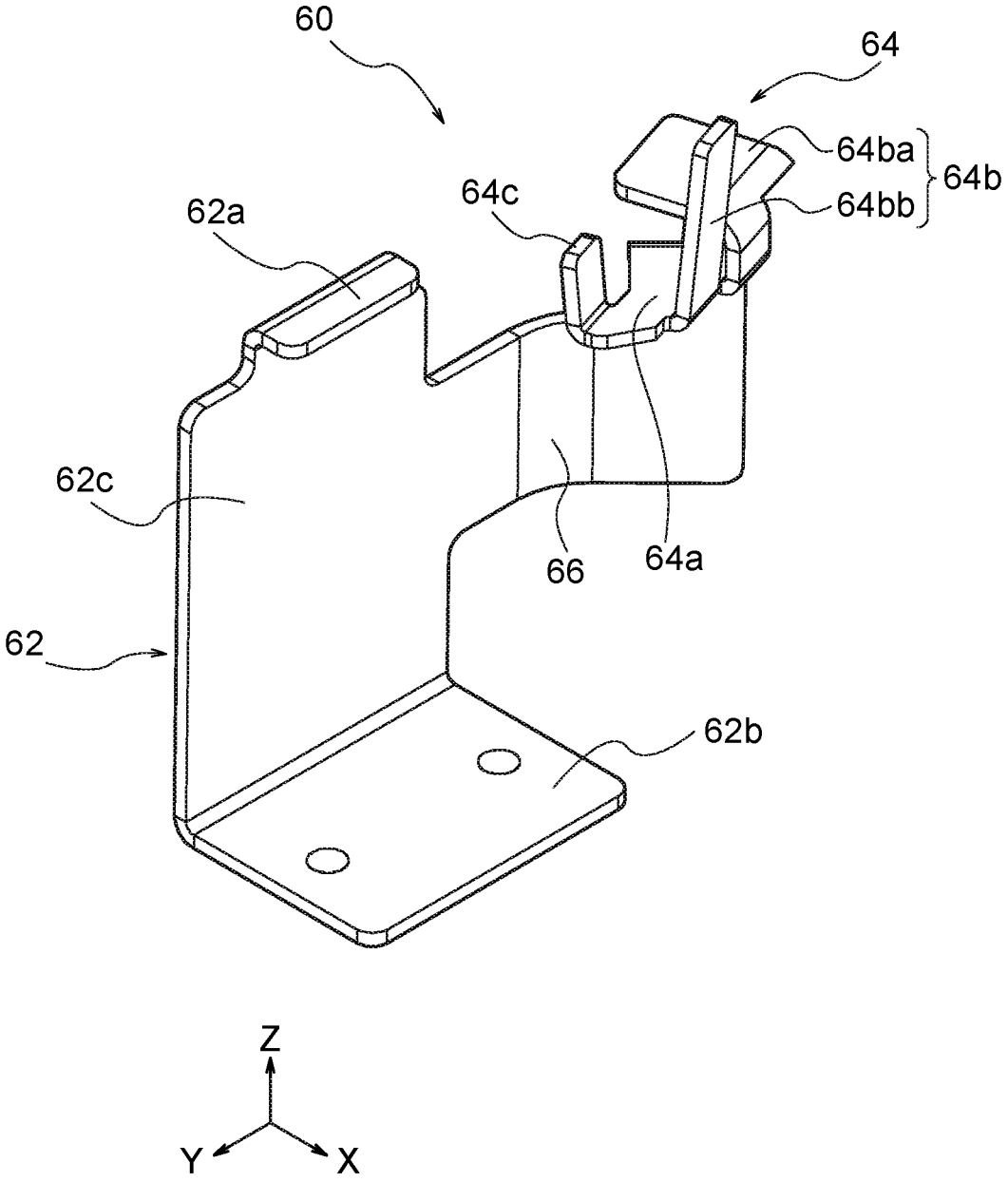
FIG. 6 is a perspective view of the second terminal portion of the coil device shown in FIG. 1.

As shown in FIG. 2 and FIG. 6, the second fixing portion 62 is provided with a second upper surface portion 62*a*, a second lower surface portion 62*b*, and a second side surface portion 62*c*. The second upper surface portion 62*a* is engaged with the engagement end surface 42*a* on the X-axis negative direction side of the outer case 40. The second lower surface portion 62*b* is engaged with the core lower surface 44 of the outer core 40. The second side surface portion 62*c* connects the second upper surface portion 62*a* and the second lower surface portion 62*b* and opposes to the core outer peripheral surface 46 of the outer core 40. The second upper surface portion 62*a* and the second lower surface portion 62*b* form an angle of approximately 90 degrees to the second side surface portion 62*c* (approximately L shape with the second side surface portion 62*c*) and are connected to the upper and lower ends of the second side surface portion 62*c*. The second lower surface portion 62*b* is provided with a convex portion engaged with a concave portion formed on the core lower surface 44 of the outer core 40 in the same manner as the first lower surface portion 52*b*.

As shown in FIG. 6, a radial length of the second upper surface portion 62*a* and a radial length of the second lower surface portion 62*b* are different from each other. As shown in FIG. 3 of a plane view, a radial tip of the second upper surface portion 62*a* is positioned on an outer diameter side of the core inner peripheral surface 48 of the outer core 40, but as shown in FIG. 2, a radial tip of the second lower surface portion 62*b* is positioned on an inner diameter side of the lower flange outer peripheral surface 26*a*. As is the case with the first fixing portion 52, the second fixing portion 62 of the second terminal portion 60 is fixed to the outer core 40 via the adhesive hardened portion connecting the inner surface of the second side surface portion 62*c* and the core outer peripheral surface 46 of the outer core 40.

As shown in FIG. 4 and FIG. 6, the second wirebound portion 64 of the second terminal portion 60 is provided with the second wirebound bottom portion 64*a*, a second wire fixing portion 64*b*, and a second support portion 64*c*. The second wirebound bottom portion 64*a* is parallel to the XY plane perpendicular to the axial direction. The second wire fixing portion 64*b* and the second support portion 64*c* are curved toward a predetermined direction to the second wirebound bottom portion 64*a* and are connected thereto. As shown in FIG. 3, the second wirebound bottom portion 64*a* is arranged on the support end surface 42*b* of the core upper surface 42 of the outer core 40.

As shown in FIG. 3, the second wire fixing portion 64*b* is provided with a second welding portion 64*ba* welded to the second end 30*b* of the wire 30 and a second caulking portion 64*bb* connected to the second wirebound bottom portion 64*a* with a predetermined distance to the second welding portion 64*ba*. The second caulking portion 64*bb* temporarily fixes the second end 30*b* on the winding side of the second end 30*b* (near the winding portion 30*c* (see FIG. 2)) compared to the second welding portion 64*ba*.

As shown in FIG. 3 and FIG. 4, the second welding portion 64*ba* and second caulking portion 64*bb* constituting the second wire fixing portion 64*b* bend from the second wirebound bottom portion 64*a* toward a clockwise direction that is the same rotating direction as the first rotating direction of the first wire fixing portion 54*b* as seen from a tip side of the second end 30*b* (approximately corresponding to the Y-axis negative direction) and fix the second end 30*b*. Incidentally, FIG. 3, FIG. 4, FIG. 6, etc. show a state where the second caulking portion 64*bb* does not fix the second end 30*b*, but in the coil device 10 after being completed, the second caulking portion 64*bb* bends further in the clockwise direction from the state shown in FIG. 3, FIG. 4, and FIG. 6 and fixes the second end 30*b* by caulking. Since the second caulking portion 64*bb* temporarily fixes the second end 30*b* by caulking, as is the case with the first caulking portion 54*bb*, it is advantageous that the second end 30*b* being temporarily fixed (before the second welding portion 64*ba* is welded) is hard to be displaced positionally.

As shown in FIG. 4 and FIG. 6, a connection position between the second wirebound bottom portion 64*a* and the second welding portion 64*ba* is distant from the second end 30*a* more than a connection position between the second wirebound bottom portion 64*a* and the second caulking portion 64*bb* in the second terminal portion 60 in the same manner as the first terminal portion 50.

As shown in FIG. 3, the second support portion 64*c* touches the second end 30*b* on its winding side compared to the second wire fixing portion 64*b*. As shown in FIG. 3 and FIG. 6, the second support portion 64*c* protrudes from the second wirebound bottom portion 64*a* toward a counterclockwise side of a reverse rotating direction side of the first rotating direction side as seen from the tip side of the second end 30*b*. Thus, the second end 30*b* of the wire 30 is pulled out toward the outer diameter direction on the second wirebound bottom portion 64*a* via between the second support portion 64*c* and the second caulking portion 64*bb*. Incidentally, the second support portion 64*c* may bend further in the counterclockwise direction from the state shown in FIG. 3 to FIG. 5 and fix the second end 30*b* by caulking in the coil device 10 after being completed in the same manner as the first support portion 54*c* of the first terminal portion 50. The connection position between the second wirebound bottom portion 64*a* and the second welding portion 64*ba* is preferably distant from the second end 30*b* more than a connection position between the second wirebound bottom portion 64*a* and the second support portion 64*c*.

As shown in FIG. 2, the second connection portion 66 is arranged along the core outer peripheral surface 46 and connects the second side surface portion 62*c* of the second fixing portion 62 and the second wirebound bottom portion 64*a* of the second wirebound portion 64. Incidentally, although not limited, the second side surface portion 62*c* of the second fixing portion 62 of the second terminal portion 60 is preferably only one that is directly adhered to the outer core 40. When only the second side surface portion 62*c* of the second terminal portion 60 is adhered to the outer core 40, the second wirebound bottom portion 64*a* of the second wirebound portion 64 and the second connection portion 66 oppose to the support end surface 42*b* or the core outer peripheral surface 46 of the outer core 40, but are not directly fixed to the surface of the outer core 40.

As clearly shown in FIG. 3 and FIG. 4, the first terminal portion 50 and the second terminal portion 60 have mutually different shapes. In particular, extending directions of the first wirebound bottom portion 54*a* and the second wirebound bottom portion 64*a* shown in FIG. 4 correspond to pull-out directions of the first and second ends 30*a* and 30*b* of the wire 30. This enables the coil device 10 to prevent a problem of causing a positional displacement of the inner core 20 due to an elastic force for bending the wire 30.

Hereinafter, a manufacturing method of the coil device 10 will be explained. In the manufacture of the coil device 10, the winding portion 30*c* is firstly formed by winding a lead wire around the winding core 22 of the inner core 20, and the inner core 20 wound by the winding portion 30*c* is then inserted into the through hole 40*a* of the outer core 40 (see FIG. 2). The inner core 20 and the outer core 40 are made by any materials, but are made using a soft magnetic material such as ferrite and metal. Any lead wire is used as the lead wire for forming the wire 30 as long as a coated wire whose surface is insulation coated is employed.

Next, the first and second terminal portions 50 and 60 where an adhesive is applied beforehand to the inner surfaces of the first and second side surface portions 52*c* and 62*c* are attached from the side of the core outer peripheral surface 46 to the outer core 40 (see FIG. 2). At this time, the first and second upper surface portions 52*a* and 62*a* of the first and second fixing portions 52 and 62 are engaged with the engagement end surfaces 42*a*, the first and second lower surface portions 52*b* and 62*b* touch the core lower surface 44, and the first and second terminal portions 50 and 60 are thus positioned to the outer core 40. The first and second ends 30*a* and 30*b* of the wire 30 are arranged along the first wirebound bottom portion 54*a* of the first terminal portion 50 and the second wirebound bottom portion 64*a* of the second terminal portion 60.

The first and second terminal portions 50 and 60 are made by any material and any method, and are made by machining a metal plate material such as copper alloy, for example. Incidentally, at this point, the first and second welding portions 54*ba* and 64*ba* of the first and second terminal portions 50 and 60 are not bent to the state shown in FIG. 1 to FIG. 6, etc., and are in a state where the tips are directed upward in the same manner as the first and second caulking portions 54*bb* and 64*bb*.

Next, the first caulking portion 54*bb* of the first wire fixing portion 54 and the second caulking portion 64*bb* of the second wire fixing portion 64 in the first and second terminal portions 50 and 60 are bent toward the first rotating direction (clockwise direction) shown in FIG. 3, are caulked with the first and second ends 30*a* and 30*b* of the wire 30, and are temporarily fixed to the first and second terminal portions 50 and 60. Furthermore, insulation coatings of the first and second ends 30*a* and 30*b* on the tip sides from the temporarily fixed portions are peeled, the first and second welding portions 54*ba* and 64*ba* are bent toward the first rotating direction (clockwise direction) to touch the peeled portions of the first and second ends 30*a* and 30*b*, and these portions are welded by laser welding or so. As a result, the first and second terminal portions 50 and 60 and the first and second ends 30*a* and 30*b* are fixed permanently.

At the end, an adhesive is injected into the space between the upper and lower flange outer peripheral surfaces 24*a* and 26*a* and the core inner peripheral surface 48 using a dispenser or so and is solidified so that the inner core 20 and the outer core 40 are joined, whereby the coil device 10 is obtained. Incidentally, after the temporary fixings by the first and second caulking portions 54*bb* and 64*bb*, the first and second support portions 54*c* and 64*c* may bend toward the counterclockwise direction of the reverse rotating direction of the first rotating direction (clockwise direction) shown in FIG. 2 and caulk the first and second ends 30*a* and 30*b* so that the fixings to the first and second terminal portions 50 and 60 are reinforced.

In the coil device 10 according to the above-mentioned embodiment, as shown in FIG. 3 or so, the first and second wire fixing portions 54*b* and 64*b*, especially the first and second caulking portions 54*bb* and 64*bb*, both bend from the first and second wirebound bottom portions 54*a* and 64*a* toward the same rotating direction (clockwise direction) and caulk the first and second ends 30*a* and 30*b*. The first caulking portion 54*bb* and the second caulking portion 64*bb* have the same rotating direction, and it is thus possible to effectively prevent a problem of positional displacement of a center of the inner core 20 when the first and second ends 30*a* and 30*b* are fixed to the first and second terminal portions 50 and 60.

This is because a resultant force of forces transmitted from the first and second caulking portions 54*bb* and 64*bb* to the inner core 20 via the wire 30 acts toward a direction where the inner core 20 is rotated around the axial direction in such a manner that the first caulking portion 54*bb* and the second caulking portion 64*bb* bend toward the same rotating direction and caulk the first and second ends 30*a* and 30*b*. It is thus possible to prevent a problem of positional displacement of a center of the inner core 20 caused by the forces transmitted to the inner core 20 when the first and second ends 30*a* and 30*b* are caulked by the first and second caulking portions 54*bb* and 64*bb*. Preventing positional displacement of a center of the inner core 20 makes it possible to accurately control a size of a gap formed between the inner core 20 and the outer core 40 and magnetic properties of the coil device 10 accompanying the size, and enables the coil device 10 to have a favorable productivity.

As shown in FIG. 3 or so, the first and second terminal portions 50 and 60 have the first and second support portions 54*c* and 64*c* protruding from the first and second wirebound bottom portions 54*a* and 64*a* toward the reverse rotating direction side of the first rotating direction. The first and second support portions 54*c* and 64*c* are in contact with the first and second ends 30*a* and 30*b* on the winding side from the first and second caulking portions 54*bb* and 64*bb* and on the reverse rotating direction side. The first and second support portions 54*c* and 64*c* can receive forces generated when the first and second caulking portions 54*bb* and 64*bb* caulk the first and second ends 30*a* and 30*b*, and it is thus possible to prevent a problem of positional displacement of a center of the inner core 20 in a fixing step by caulking.

When the first and second terminal portions 50 and 60 have the first and second support portions 54*c* and 64*c*, contact areas between the first and second terminal portions 50 and 60 and the first and second ends 30*a* and 30*b* are large. Thus, the first and second terminal portions 50 and 60 can effectively release a heat generated when the first and second welding portions 54*ba* and 64*ba* are welded to the first and second ends 30*a* and 30*b*, and it is possible to prevent a problem that this heat is transmitted to the winding portion 30*c* and damages the insulation coating or so.

The first and second wire fixing portions 54*b* and 64*b* shown in FIG. 3 or so have the first and second welding portions 54*ba* and 64*ba* and the first and second caulking portions 54*bb* and 64*bb*, both of which are separately connected to the first and second wirebound bottom portions 54*a* and 64*a*. This enables the first and second terminal portions 50 and 60 to temporarily fix the first and second ends 30*a* and 30*b* in quick and reliable manner by the first and second caulking portions 54*bb* and 64*bb*. When the first and second caulking portions 54*bb* and 64*bb* are arranged on the winding portion sides, a good workability is achieved because the temporarily fixed portions by the first and second caulking portions 54*bb* and 64*bb* become unobstructive at the time of permanent fixings where the first and second welding portions 54*ba* and 64*ba* are welded to the first and second ends 30*a* and 30*b*. Furthermore, this arrangement demonstrates an effect that the heat generated at the time of welding the first and second welding portions 54*ba* and 64*ba* to the first and second ends 30*a* and 30*b* becomes hard to be transmitted to the side of the winding portion 30*c* of the wire 30.

In the coil device 10, as shown in FIG. 1 and FIG. 5 or so, the connection positions "A" between the first and second welding portions 54*ba* and 64*ba* and the first and second wirebound bottom portions 54*a* and 64*a* are distant from the first and second ends 30*a* and 30*b* more than the connection positions "B" between the first and second caulking portions 54*bb* and 64*bb* and the first and second wirebound bottom portions 54*a* and 64*a*. The coil device 10 can prevent a problem that a force of moving a center position of the inner core 20 is generated when the first and second welding portions 54*ba* and 64*ba* are bent toward the first rotating direction (clockwise direction) after the temporary fixings by the first and second caulking portions 54*bb* and 64*bb*.

Incidentally, the above-mentioned embodiment is just an example of embodiments included by the present invention, and various modification may be added to the embodiments as long as the problem of the invention can be solved. For example, the inner core 20 is a so-called drum core having flanges on its both ends, but the inner core 20 used for the coil device 10 is not limited to one shown in FIG. 2 or so, and may be one with the winding core 22 and the upper and lower flanges 24 and 26 having a cross sectional shape of ellipse, polygon, etc. The upper and lower flanges 24 and 26 of the inner core 20 may have diameters equal to each other or different from each other.

Figure 8:
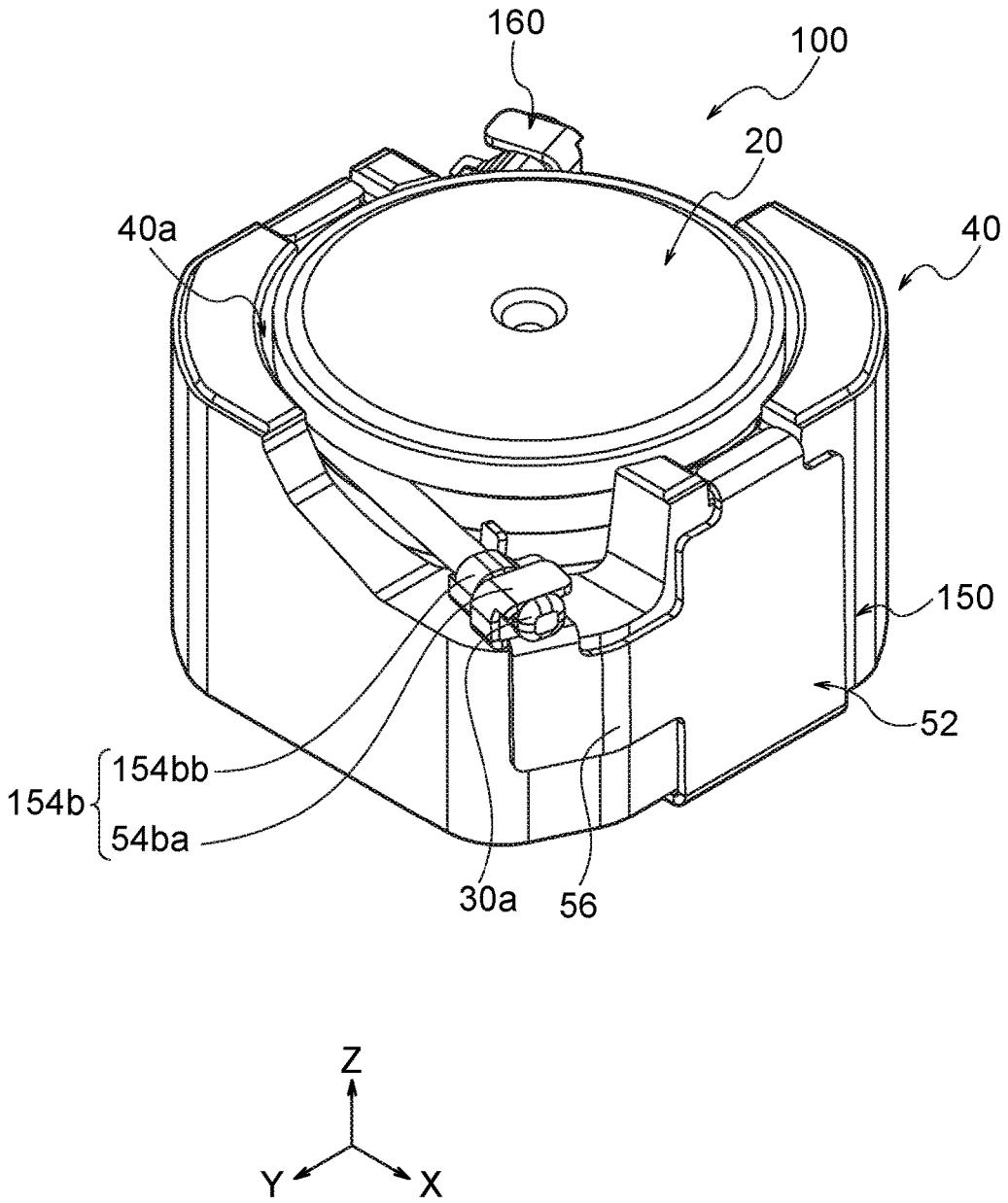
FIG. 8 is a whole perspective view of a coil device according to First Variation.

FIG. 8 is an external view showing a coil device 100 according to First Variation of the present invention. The coil device 100 according to First Variation is the same as the coil device 10 according to the embodiment except that a first wire fixing portion 154*b* and a second wire fixing portion of first and second terminal portions 150 and 160 have a different shape from that of the coil device 10 shown in FIG. 1. Thus, in the coil device 100, only differences from the coil device 10 will be explained, and common parts will not be explained.

Figure 9:
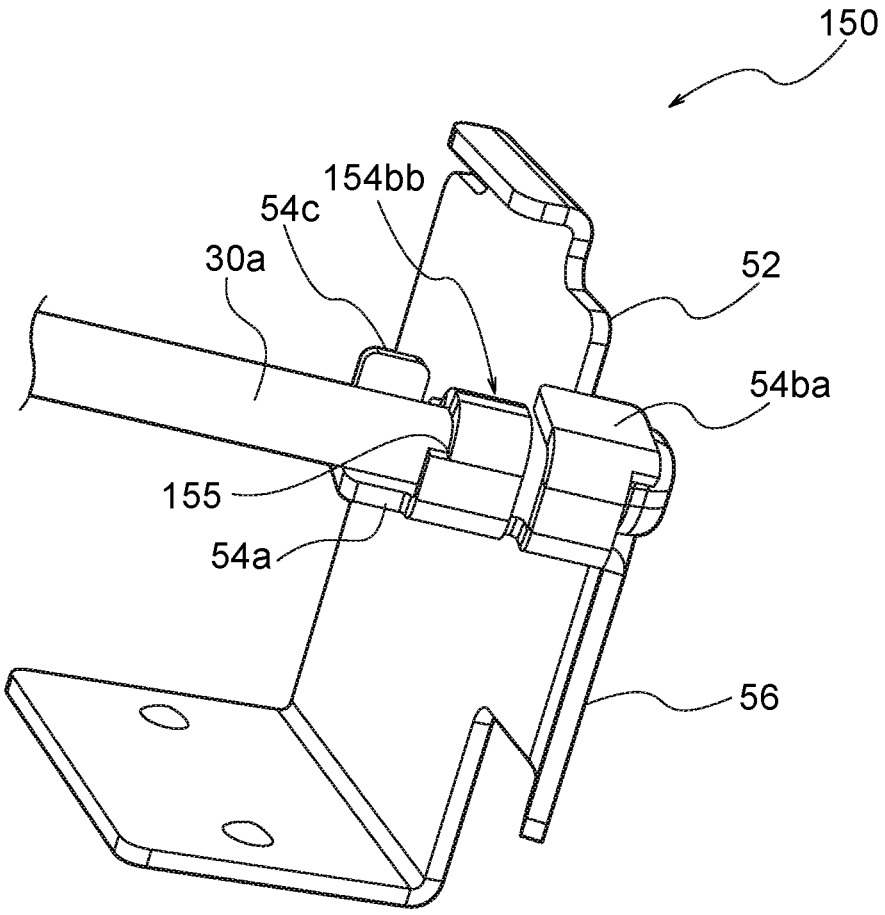
FIG. 9 is a partially enlarged view showing a fixing portion of a first terminal portion and a first end of the coil device shown in FIG. 8.

FIG. 9 is a partially enlarged view showing a fixing portion between the first terminal portion 150 and a first end 30*a* of the coil device 100 shown in FIG. 8, and shows only the first terminal portion 150 and the first end 30*a* of the coil device 100. As shown in FIG. 9, a first caulking portion 154*bb* of the first terminal portion 150 has a soft portion 155 that bends more easily than a base portion located closer to the first wirebound bottom portion 54*a* than the soft portion 155. In the first caulking portion 154*bb*, the portion on the tip side from the soft portion 155 is narrower than the portion on the base portion side from the soft portion 155. When the first caulking portion 154*bb* is bent to caulk the first end 30*a*, the first caulking portion 154*bb* is bent largely at the soft portion 155.

In the first terminal portion 150 having the soft portion 155, when the first caulking portion 154*bb* is bent to caulk the first end 30*a*, it is thus possible to prevent the base portion of the first caulking portion 154*bb* from providing the first end 30*a* with a force toward directions other than the Z-axis direction and prevent generation of a force of moving the inner core 20. When the portion on the tip side of the soft portion 155 bends and caulks the first end 30*a*, it is also possible to prevent the other portions of the first terminal portion 150, such as the first wirebound bottom portion 54*a*. The second terminal portion 160 shown in FIG. 8 has a soft portion similar to that of the first terminal portion 150.

Incidentally, the soft portion 155 is not limited to the shape where the first caulking portion 154*bb* is provided with a step and the tip side of the first caulking portion 154*bb* is entirely narrow as shown in FIG. 9, and may employ a shape where the caulking portion is provided with a slit to be partly narrow, a shape where the caulking portion partly has a small thickness (only the tip side, for example), or the like. Incidentally, FIG. 8 and FIG. 9 show a state where the first caulking portion 154*bb* fixes the first end 30*a*, but the first and second ends 50 and 60 shown in FIG. 1 to FIG. 6 also caulk and fix the first end 30*a* in the coil device 10 after being completed in the same manner as the first caulking portion 154*bb* shown in FIG. 8 and FIG. 9.

The first and second caulking portions 54*bb* and 64*bb* shown in FIG. 3 and FIG. 4 are both bent clockwise from the first and second wirebound bottom portions 54*a* and 64*a*, but may be bent in the same rotating direction. For example, the first and second caulking portions 54*bb* and 64*bb* may be both bent counterclockwise.

The first and second support portions 54*c* and 64*c* shown in FIG. 1 to FIG. 6 have a bending axis parallel to the extending directions of the first and second ends 30*a* and 30*b* and parallel to bending axes of the first and second wire fixing portions 54*b* and 64*b*, and are bent from the first and second wirebound bottom portion 54*a* and 64*a* toward the reverse rotating direction of the first rotating direction. The first and second support portions 54*c* and 64*c* are, however, not limited to this shape.

Figure 10:
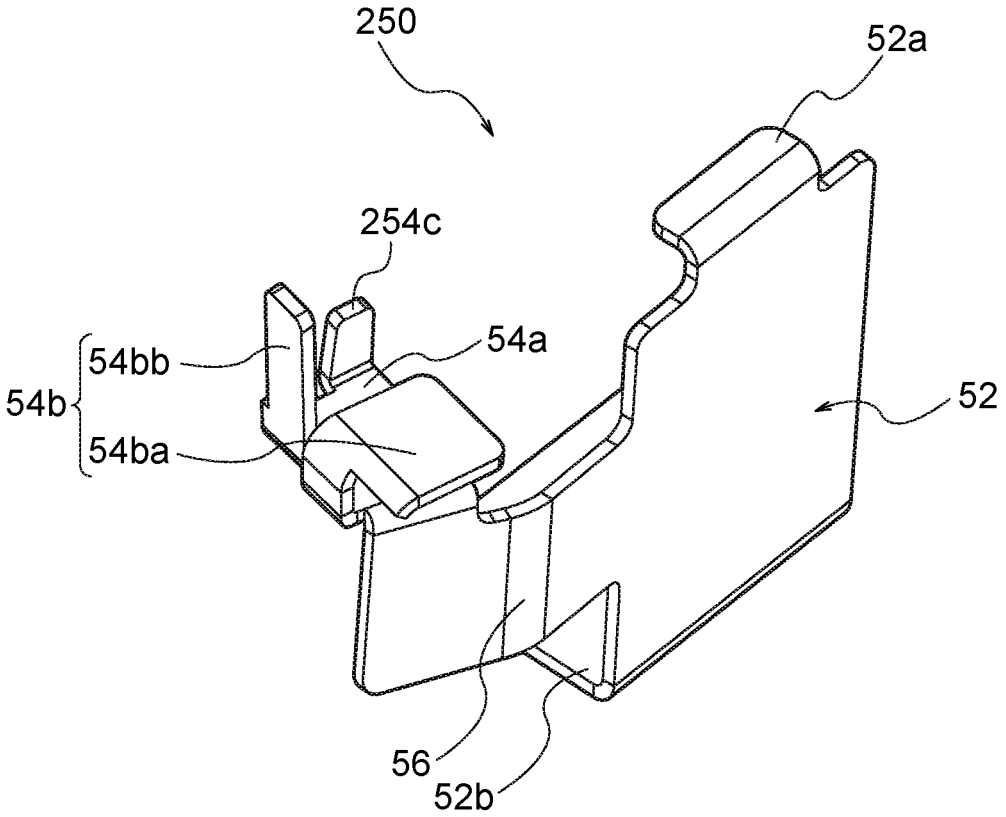
FIG. 10 is a perspective view showing a first terminal portion according to Second Variation.

For example, the first and second support portions may be a protrusion bent from the first wirebound bottom portion 54*a* along a bending axis crossing the extending direction of the first end 30*a*, or may be a protrusion protruding from the first wirebound bottom portion 54*a* toward the Z-axis direction, such as a first support portion 254*c* included by a first terminal portion 250 shown in FIG. 10. The first support portion 254*c* shown in FIG. 10 is hard to be used for caulking the first end 30*a*, but can more securely receive a force generated when the first caulking portion 54*bb* caulks the first and second ends 30*a* and 30*b*. The first terminal portion 250 having the first support portion 254*c* and the second terminal portion having a similar support portion can be used instead of the first and second terminal portions 50 and 60 shown in FIG. 5 and FIG. 6, for example.

NUMERICAL REFERENCES

10 . . . coil device
20 . . . inner core
22 . . . winding core
24 . . . upper flange
26 . . . lower flange
30 . . . wire
30*a* . . . first end
30*b* . . . second end
30*c* . . . winding portion
40 . . . outer core
40*a* . . . through hole
42 . . . core upper surface
42*a* . . . engagement end surface
42*b* . . . support end surface
44 . . . core lower surface

46 . . . core outer peripheral surface
48 . . . core inner peripheral surface
50 . . . first terminal portion
52 . . . first fixing portion
52*a* . . . first upper surface portion
52*b* . . . first lower surface portion
52*c* . . . first side surface portion
54 . . . first wirebound portion
54*a* . . . first wirebound bottom portion
54*b* . . . first wire fixing portion
54*ba* . . . first welding portion
54*bb* . . . first caulking portion
54*c* . . . first support portion
56 . . . first connection portion
60 . . . second terminal portion
62 . . . second fixing portion
62*a* . . . second upper surface portion
62*b* . . . second lower surface portion
62*c* . . . second side surface portion
64 . . . second wirebound portion
64*a* . . . second wirebound bottom portion
64*b* . . . second wire fixing portion
64*ba* . . . second welding portion
64*bb* . . . second caulking portion
64*c* . . . second support portion
66 . . . second connection portion

The invention claimed is:

1. A coil device comprising:

an inner core having a winding core with column shape extending in an axial direction and a pair of flanges arranged on both ends of the winding core;

a wire having (1) a winding portion winding around the winding core and (2) a first end and a second end extending from the winding portion;

an outer core having a through hole that receives the inner core and being arranged on an outer periphery of the inner core;

a first terminal portion provided with a first wirebound portion having a first wirebound bottom portion that (1) abuts a core end surface of one of end surfaces of the outer core in the axial direction and (2) is directly connected to the first end and a second terminal portion provided with a second wirebound portion having a second wirebound bottom portion that (1) abuts the core end surface, (2) is rotated in a peripheral direction by a predetermined angle from the first wirebound bottom portion on the core end surface and (3) is directly connected to the second end, wherein:

the first wirebound portion is provided with a first wire fixing portion bending from the first wirebound bottom portion toward a first rotating direction as seen from a tip side of the first end and fixing the first end, the first rotating direction being around a first axis of rotation that is perpendicular to the axial direction; and the second wirebound portion is provided with a second wire fixing portion bending from the second wirebound bottom portion toward the same rotating direction as the first rotating direction as seen from a tip side of the second end and fixing the second end.

2. The coil device according to claim 1, wherein the first wirebound portion is provided with a first support portion protruding from the first wirebound bottom portion toward a reverse rotating direction of the first rotating direction as seen from the tip side of the first end and touching the first end on its winding side compared to the first wire fixing portion, and the second wirebound portion is provided with a second support portion protruding from the second wirebound bottom portion toward a reverse rotating direction of the first rotating direction as seen from the tip side of the second end and touching the second end on its winding side compared to the second wire fixing portion.

3. The coil device according to claim 1, wherein the first wire fixing portion is provided with a first welding portion welded to the first end and a first caulking portion connected to the first wirebound bottom portion with a predetermined space to the first welding portion and temporarily fixing the first end on its winding side compared to the first welding portion, and the second wire fixing portion is provided with a second welding portion welded to the second end and a second caulking portion connected to the second wirebound bottom portion with a predetermined space to the second welding portion and temporarily fixing the second end on its winding side compared to the second welding portion.

4. The coil device according to claim 2, wherein the first wire fixing portion is provided with a first welding portion welded to the first end and a first caulking portion connected to the first wirebound bottom portion with a predetermined space to the first welding portion and temporarily fixing the first end on its winding side compared to the first welding portion, and the second wire fixing portion is provided with a second welding portion welded to the second end and a second caulking portion connected to the second wirebound bottom portion with a predetermined space to the second welding portion and temporarily fixing the second end on its winding side compared to the second welding portion.

5. The coil device according to claim 3, wherein a connection position between the first wirebound bottom portion and the first welding portion is distant from the first end more than a connection position between the first wirebound bottom portion and the first caulking portion, and a connection position between the second wirebound bottom portion and the second welding portion is distant from the second end more than a connection position between the second wirebound bottom portion and the second caulking portion.

6. The coil device according to claim 4, wherein a connection position between the first wirebound bottom portion and the first welding portion is distant from the first end more than a connection position between the first wirebound bottom portion and the first caulking portion, and a connection position between the second wirebound bottom portion and the second welding portion is distant from the second end more than a connection position between the second wirebound bottom portion and the second caulking portion.

7. The coil device according to claim 1, wherein the first wirebound portion is provided with a first support portion protruding from the first wirebound bottom portion and touching the first end on its winding side compared to the first wire fixing portion, and the second wirebound portion is provided with a second support portion protruding from the second wirebound bottom portion and touching the second end on its winding side compared to the second wire fixing portion.

* * * * *